US007367167B2

(12) United States Patent
Takayanagi

(10) Patent No.: US 7,367,167 B2
(45) Date of Patent: May 6, 2008

(54) BLOCK

(75) Inventor: Hiroshi Takayanagi, Iiyama (JP)

(73) Assignee: Hokusei Shoji Corporation, Nagano (JP)

( * ) Notice: Subject to any disclaimer, the term of this patent is extended or adjusted under 35 U.S.C. 154(b) by 359 days.

(21) Appl. No.: 10/529,788

(22) PCT Filed: Sep. 30, 2003

(86) PCT No.: PCT/JP03/12557

§ 371 (c)(1),
(2), (4) Date: Dec. 6, 2005

(87) PCT Pub. No.: WO2004/031502

PCT Pub. Date: Apr. 15, 2004

(65) Prior Publication Data

US 2006/0123732 A1 Jun. 15, 2006

(30) Foreign Application Priority Data

Oct. 3, 2002 (JP) ..... 2002-291030

(51) Int. Cl.
*E02D 29/02* (2006.01)

(52) U.S. Cl. ..... 52/604; 52/561; 52/605; 52/592.1; 52/574; 404/41; 405/284; 405/286

(58) Field of Classification Search ..... 52/605, 52/596, 578, 604, 608, 609, 574, 561, 562, 52/588.1, 591.1, 592.6, 575; 405/262, 284, 405/286, 34; 404/34, 31; 403/364, 300, 403/314, 339, 340; 446/108, 124, 125
See application file for complete search history.

(56) References Cited

U.S. PATENT DOCUMENTS 4,227,829 A * 10/1980 Landry, Jr. ..... 405/20
4,524,551 A * 6/1985 Scheiwiller ..... 405/286
4,781,492 A * 11/1988 Shindo ..... 405/16
5,601,384 A * 2/1997 Dawson ..... 405/284

(Continued)

FOREIGN PATENT DOCUMENTS

DE 2110563 9/1972
EP 1180562 2/2002

(Continued)

*Primary Examiner*—Victor Batson
*Assistant Examiner*—James J Buckle, Jr.
(74) *Attorney, Agent, or Firm*—Greenblum & Bernstein, P.L.C.

(57) ABSTRACT

A block according to the present invention is a block comprising a base body part, a first protruding part, and a second protruding part, which are integrally formed with each other. The base body part has a left lower side face, a right lower side face, a left upper side face, and a right upper side face formed as respective sloping faces. The first protruding part has a lower surface thereof formed by first to third left-hand sloping faces, an upper surface thereof formed by fourth to sixth left-hand sloping faces, and a left side surface thereof formed by seventh and eighth left-hand sloping faces. The second protruding part has a lower surface thereof formed by first to third right-hand sloping faces, an upper surface thereof formed by fourth to sixth right-hand sloping faces, and a right side surface thereof formed by seventh and eighth right-hand sloping faces. The faces of the lower portion of the block are each formed with a fitting groove, and the faces of the upper portion of the block are each formed with a fitting protrusion.

8 Claims, 8 Drawing Sheets

U.S. PATENT DOCUMENTS

| | | | | | |
|---|---|---|---|---|---|
| D399,577 | S | * | 10/1998 | Scales | D25/115 |
| 5,921,710 | A | * | 7/1999 | Scales | 405/20 |
| 6,071,041 | A | * | 6/2000 | Knight | 405/16 |
| 6,298,628 | B1 | | 10/2001 | Nakao | |
| 6,866,446 | B2 | * | 3/2005 | McAllister et al. | 405/16 |
| 2005/0028475 | A1 | * | 2/2005 | Barlow et al. | 52/578 |

FOREIGN PATENT DOCUMENTS

| | | |
|---|---|---|
| JP | 58-89511 | 6/1983 |
| WO | 81/02983 | 10/1981 |
| WO | 00/43606 | 7/2000 |

* cited by examiner

BLOCK

TECHNICAL FIELD

The present invention relates to blocks that enable a structure to be assembled by arranging the blocks in a side-by-side fashion with parts thereof fitted to each other.

BACKGROUND ART

As a block of this kind, a block (1) is disclosed in WO00/43606. In this case, the block is formed with engaging parts (2, 2), a fitting protrusion (3), a fitting groove (4), and an insertion hole (5), and a plurality of blocks (1) can be stacked one upon another to thereby assemble a wall (structure) of a house or the like. To assemble these blocks (1) into a structure, while connecting laterally adjacent blocks (1) by fitting the engaging parts thereof to each other, each of the blocks (1) is stacked on another block positioned immediately below by fitting the fitting groove thereof on the fitting protrusion of the block positioned immediately below. This method makes it possible to assemble a highly airtight structure which is capable of preventing infiltration of rain water.

DISCLOSURE OF THE INVENTION

As a result of the study of the above block, the present inventor found the following problems: In the case of the conventional block (1), in order to assemble a structure, each block (1) is pushed in downward, whereby the engaging parts are engaged with the respective associated engaging parts of other blocks and the fitting groove thereof is fitted on the fitting protrusion of another block. In this case, this block is formed such that when the structure is assembled, a gap is not produced between each of the faces (e.g. a side face (21*a*) of an engaging part) defining the engaging parts, the fitting protrusion, and the fitting groove and the faces of the opposite lateral sides of the main body of the block, and the associated one of the faces of the other blocks to be fitted. For this reason, when blocks are fitted to each other, these faces are brought into sliding contact with each other, which causes large frictional resistance, and hence it is required to push in the block (1) downward with a strong force. Further, when it is difficult to push the block (1) into another block, a hammer or the like, for example, has to be used to hit the top surface of the block (1) to thereby fit the block (1) to the other block. Therefore, labor is required for fitting the blocks, which makes assembly work of the structure tough. In this case, it could be considered to form the blocks (1) such that when the structure is assembled, a slight gap is produced between the associated faces thereof, to thereby facilitate fitting work. However, this method suffers from the problem that airtightness can be reduced to allow infiltration of rain water and the like.

The present invention has been made to solve the problems described above, and a main object thereof is to provide blocks which can be easily assembled into a highly airtight structure.

The block according to the present invention is a block for enabling a structure to be assembled by arranging blocks in a side-by-side fashion with parts thereof fitted to each other, wherein a base body part positioned in a central portion of the block and having upper and lower faces formed such that the upper and lower faces are flat and parallel to each other, a first protruding part protruding leftward from the base body part, and a second protruding part protruding rightward from the base body part are integrally formed with the base body part, wherein the base body part has sloping faces formed from a lower end of a left lower side face of the base body part to a protrusion of the first protruding part, and from a lower end of a right lower side face of the base body part to a protrusion of the second protruding part, such that as the sloping faces extend upward, the sloping faces become more distant from a central vertical axis of the block in a left-right direction, and sloping faces formed from an upper end of a left upper side face of the base body part to a protrusion of the first protruding part and from an upper end of a right upper side face of the base body part to a protrusion of the second protruding part, such that as the sloping faces extend downward, the sloping faces become more distant from the central vertical axis, wherein the first protruding part has a lower surface thereof formed by a first left-hand sloping face formed such that as the first left-hand sloping face extends leftward from the protrusion corresponding to the left lower side face of the base body part, the first left-hand sloping face becomes closer to a central horizontal axis in a vertical direction of the block, a second left-hand sloping face formed continuous with a left end of the first left-hand sloping face such that as the second left-hand sloping face extends leftward, the second left-hand sloping face becomes more distant from the central horizontal axis, and a third left-hand sloping face formed continuous with a left end of the second left-hand sloping face such that as the third left-hand sloping face extends leftward, the third left-hand sloping face becomes closer to the central horizontal axis, an upper surface thereof formed by a fourth left-hand sloping face formed such that as the fourth left-hand sloping face extends leftward from the protrusion corresponding to the left upper side face of the base body part, the fourth left-hand sloping face becomes closer to the central horizontal axis, a fifth left-hand sloping face formed continuous with a left end of the fourth left-hand sloping face such that as the fifth left-hand sloping face extends leftward, the fifth left-hand sloping face becomes more distant from the central horizontal axis, and a sixth left-hand sloping face formed continuous with a left end of the fifth left-hand sloping face such that as the sixth left-hand sloping face extends leftward, the sixth left-hand sloping face becomes closer to the central horizontal axis, and a left side surface thereof formed by a seventh left-hand sloping face formed continuous with a left end of the third left-hand sloping face such that the seventh left-hand sloping face extends parallel with the right upper side face of the base body part, and an eighth left-hand sloping face formed continuous with a left end of the sixth left-hand sloping face such that the eighth left-hand sloping face extends parallel with the right lower side face of the base body part, wherein the second protruding part has a lower surface thereof formed by a first right-hand sloping face formed continuous with the protrusion corresponding to the right lower side face of the base body part such that the first right-hand sloping face extends parallel with the sixth left-hand sloping face, a second right-hand sloping face formed continuous with a right end of the first right-hand sloping face such that the second right-hand sloping face extends parallel with the fifth left-hand sloping face, and a third right-hand sloping face formed continuous with a right end of the second right-hand sloping face such that the third right-hand sloping face extends parallel with the fourth left-hand sloping face, an upper surface thereof formed by a fourth right-hand sloping face formed continuous with the protrusion corresponding to the right upper side face of the base body part such that the fourth right-hand sloping face extends parallel with the third left-hand sloping face, a fifth right-hand sloping face formed continuous with a right end of the fourth right-hand sloping face such that the fifth right-hand sloping face extends parallel with the second left-hand sloping face, and a sixth right-hand sloping face formed continuous with a right end of the fifth right-hand sloping face such that the sixth right-hand sloping face extends parallel with the first left-hand sloping face, and a right side surface thereof formed by a seventh right-hand sloping face formed continuous with a right end of the third right-hand sloping face such that the seventh right-hand sloping face extends parallel with the left upper side face of the base body part, and an eighth right-hand sloping face formed continuous with a right end of the sixth right-hand sloping face such that the eighth right-hand sloping face extends parallel with the left lower side face of the base body part, wherein the seventh left-hand sloping face, the lower surface of the first protruding part, the left lower side face of the base body part, the lower face of the base body part, the right lower side face of the base body part, the lower surface of the second protruding part, and the seventh right-hand sloping face are each formed with a fitting groove extending in a left-right direction thereof, wherein the eighth left-hand sloping face, the upper surface of the first protruding part, the left upper side face of the base body part, the upper face of the base body part, the right upper side face of the base body part, the upper surface of the second protruding part, and the eighth right-hand sloping face are each formed with a fitting protrusion extending in a left-right direction thereof and protruding therefrom, wherein the fitting protrusion formed on the upper face of the base body part of the block is configured such that the fitting protrusion can be fitted in the fitting groove formed in the lower face of the base body part of another block configured similarly to the block, wherein the fitting protrusions formed on the eighth left-hand sloping face, the upper surface of the first protruding part, and the left upper side face of the base body part, respectively, are configured such that the fitting protrusions can be fitted in the respective fitting grooves formed in the right lower side face of the base body part, the lower surface of the second protruding part, and the seventh right-hand sloping face of another block configured similarly to the block, and wherein the fitting protrusions formed on the right upper side face of the base body part, the upper surface of the second protruding part, and the eighth right-hand sloping face, respectively, are configured such that the fitting protrusions can be fitted in the respective fitting grooves formed in the seventh left-hand sloping face, the lower surface of the first protruding part, and the left lower side face of the base body part of another block configured similarly to the block.

In this block, the left and right lower side faces and left and right upper side faces of the base body part are formed as the respective sloping faces. Further, the lower surface, upper surface and left side surface of the first protruding part protruding leftward from the base body part and the lower surface, upper surface and right side surface of a second protruding part protruding rightward from the base body part are each formed by a plurality of sloping faces. Furthermore, the faces of the lower portion of the block are each formed with a fitting groove, while the faces of the upper portion of the block are each formed with a fitting protrusion. As a result, the block can be fitted to other blocks without causing friction between the associated faces and simply by its own weight or by pushing in the block with a slight force. This makes it possible to easily assemble a structure which ensures high airtightness at the fitted portions of blocks.

Further, it is preferred that a right-hand half body and a left-hand half body are formed in rotationally symmetrical relationship with respect to the central vertical axis. With this construction, it is possible to dispense with work for distinguishing between the front and the back of a block in assembling a structure, thereby enhancing working efficiency.

Further, it is preferred that a branch part having a same shape as a shape of a right-hand or left-hand half body of the block is formed in a manner protruding from at least one of front and back surfaces of the block. With this construction, one structure can have another structure easily connected thereto.

Furthermore, an insertion hole through which a bar-like reinforcing member can be inserted is formed vertically through the block. With this construction, the reinforcing members are erected on a foundation for assembling a structure, for example, and each of the reinforcing members is inserted through the associated insertion hole, whereby the blocks are arranged in a side-by-side fashion. Thus, a structure which ensures high airtightness and rigidity can be easily assembled.

It should be noted that the present disclosure relates to the subject matter included in Japanese Patent Application No. 2002-291030 filed Oct. 3, 2002, and it is apparent that all the disclosures therein are incorporated herein by reference.

BEST MODE FOR CARRYING OUT THE INVENTION

Hereinafter, the best mode of a block according to the present invention will be described with reference to the accompanying drawings.

First, the construction of a building block 1 (an example of a block according to the present invention) will be described with reference to the drawings.

Figure 1:
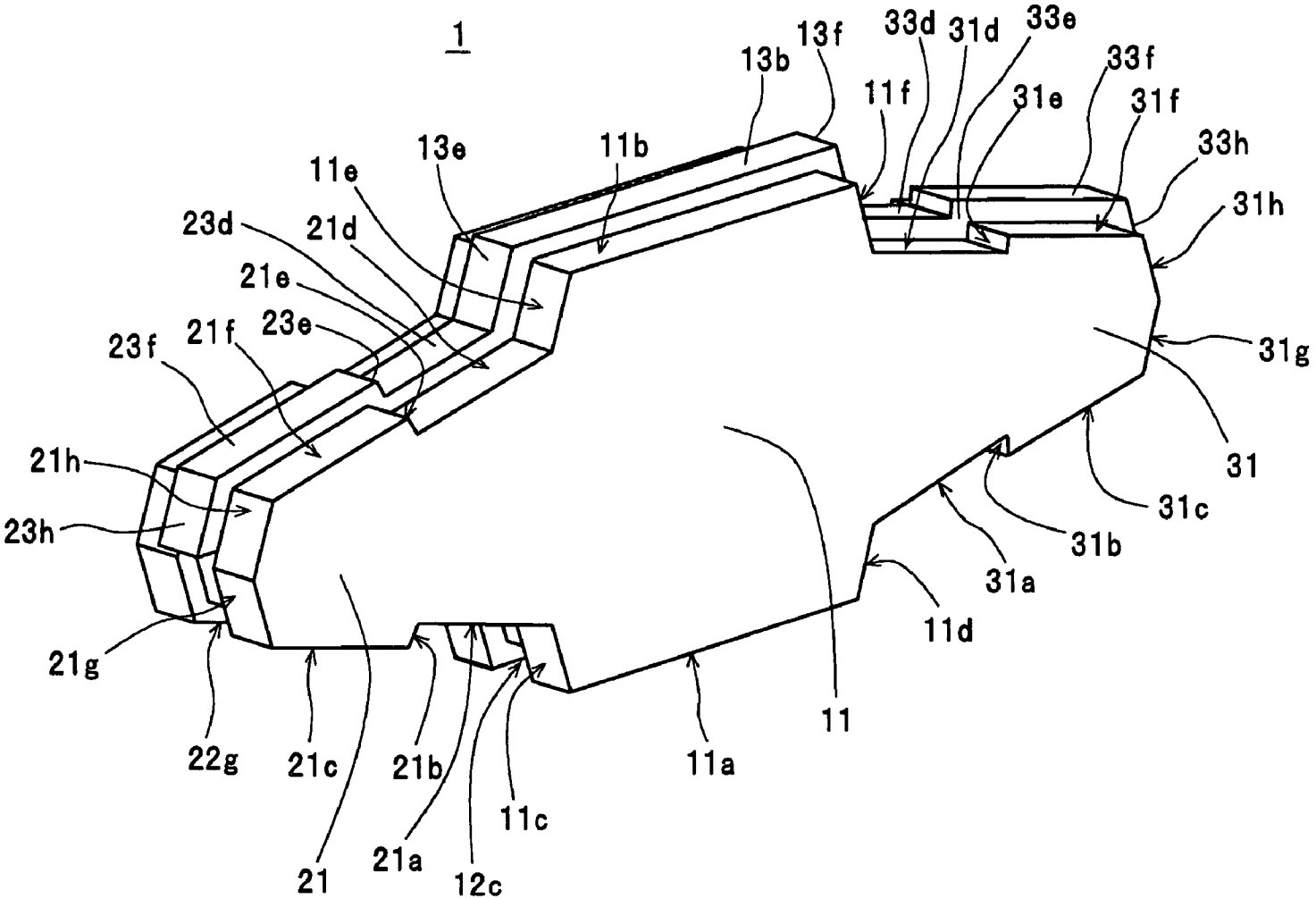
FIG. 1 is a perspective view of a building block 1.
Figure 2:
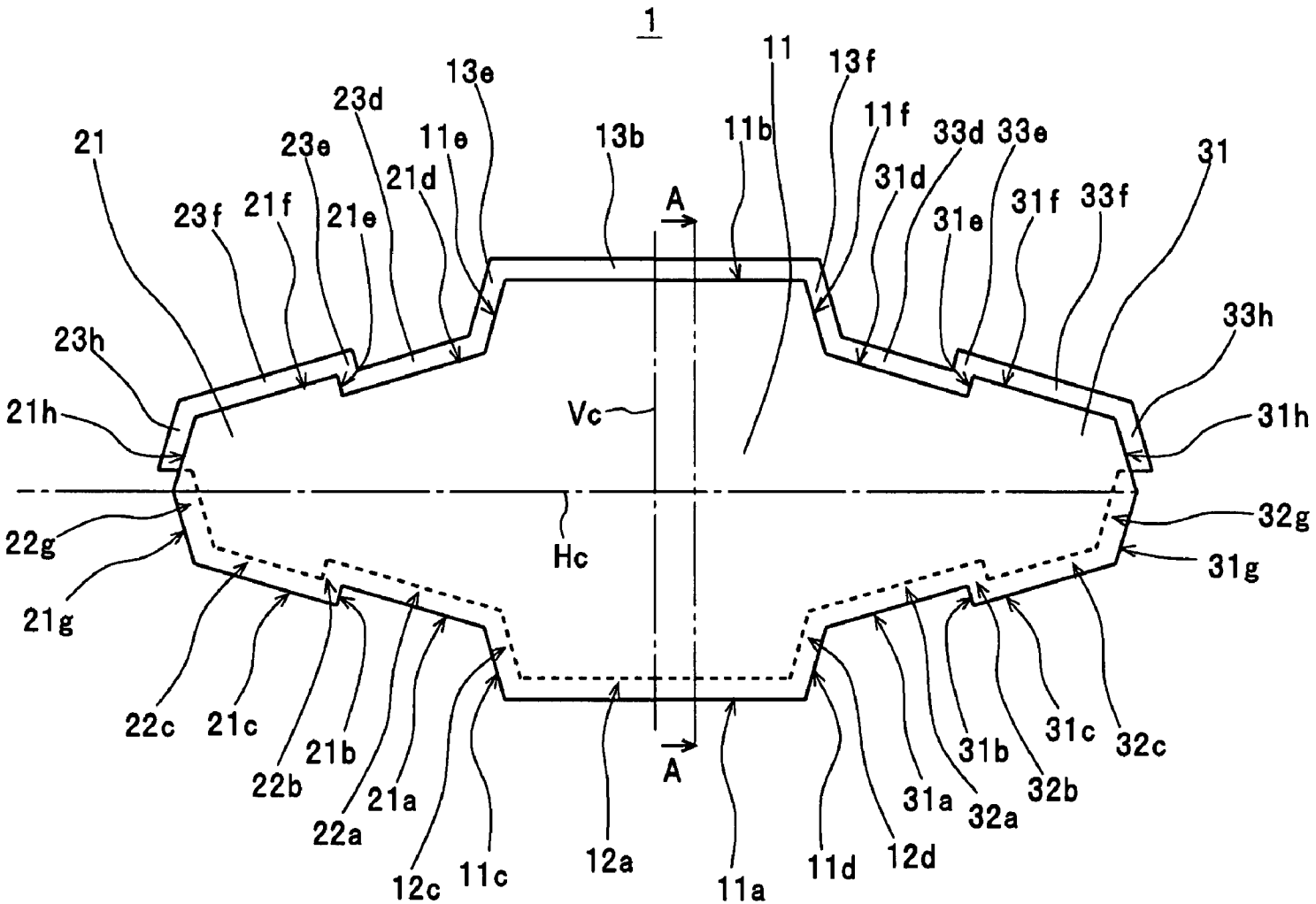
FIG. 2 is a front view of the building block 1.

The building blocks 1 enable a wall-like structure to be assembled by arranging the same in a side-by-side fashion with parts thereof fitted to each other. For example, the building block 1 has reinforcing steel rods embedded therein, and is generally formed of concrete such that it has a plate shape with a predetermined thickness. In this case, as shown in FIG. 1, the building block 1 is integrally formed by a base body part 11 and protruding parts 21 and 31 protruding leftward and rightward, respectively, from the base body part 11 such that the building block 1 is generally cross-shaped in front view. Further, the building block 1 is formed such that the right-hand half body thereof and the left-hand half body thereof are rotationally symmetrical with respect to a central vertical axis Vc (see FIG. 2) located at the center in the left-right direction and in the direction of thickness. As shown in FIG. 2, the base body part 11 is located in the central portion of the building block 1, and has a lower face 11*a* thereof and an upper face 11*b* thereof which are flat and in parallel relationship to each other. Further, the base body part 11 has a left lower side face 11*c* thereof and a right lower side face 11*d* thereof formed as respective sloping faces such that as they extend upward from the lower face 11*a*, they become more distant from the central vertical axis Vc. Furthermore, the base body part 11 has a left upper side face 11*e* thereof and a right upper side face 11*f* thereof formed as respective sloping faces such that as they extend downward from the upper face 11*b*, they become more distant from the central vertical axis Vc.

Figure 3:
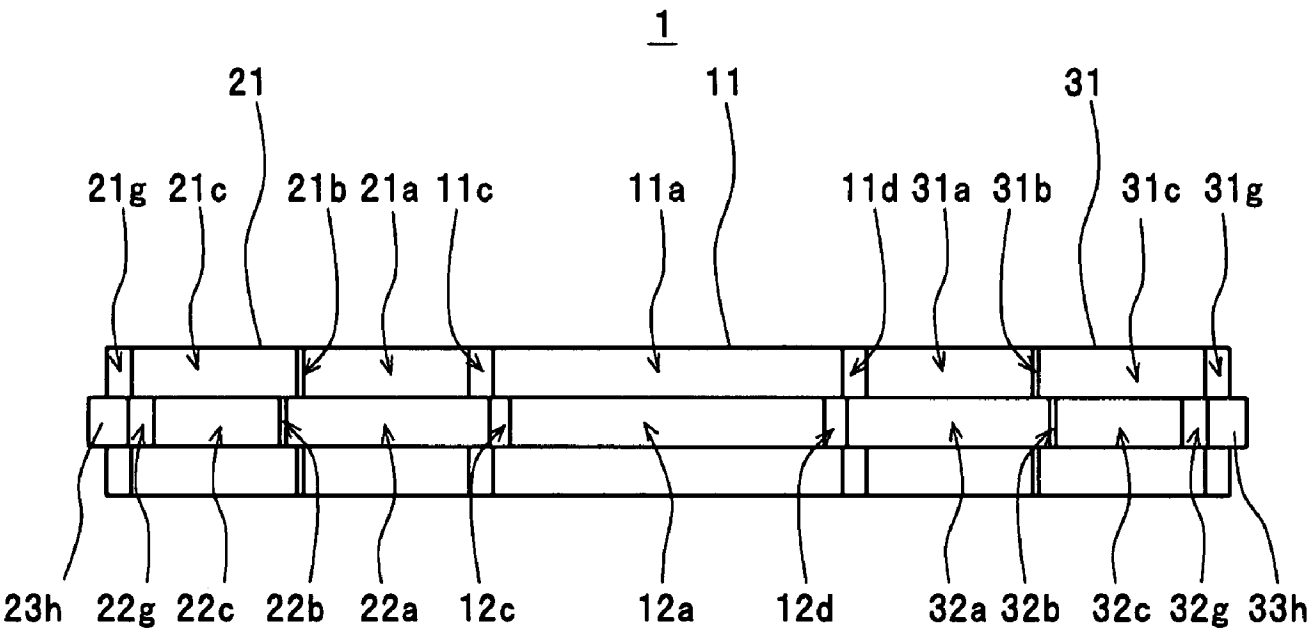
FIG. 3 is a bottom view of the building block 1.
Figure 4:
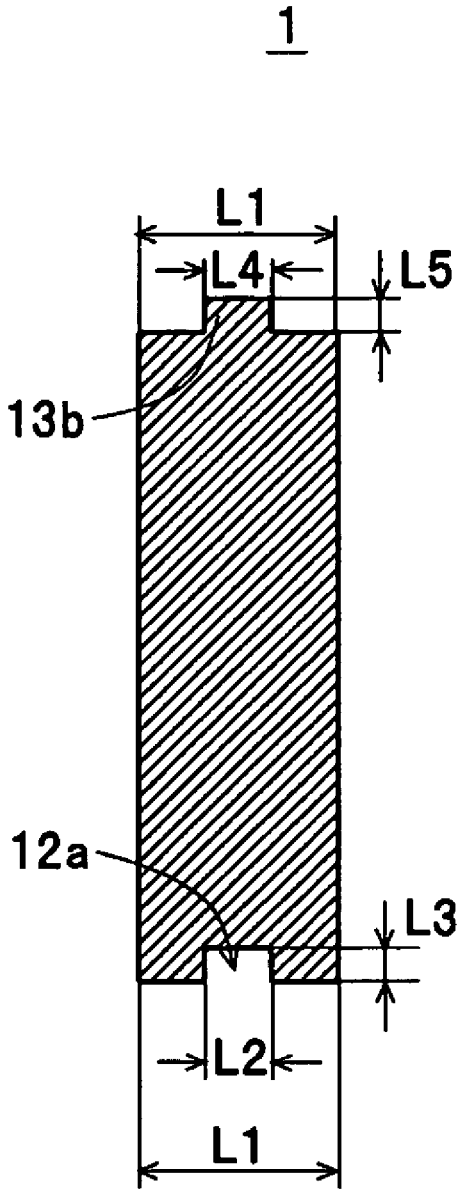
FIG. 4 is a cross-sectional view of the building block 1 taken on line A-A in FIG. 2.
Figure 5:
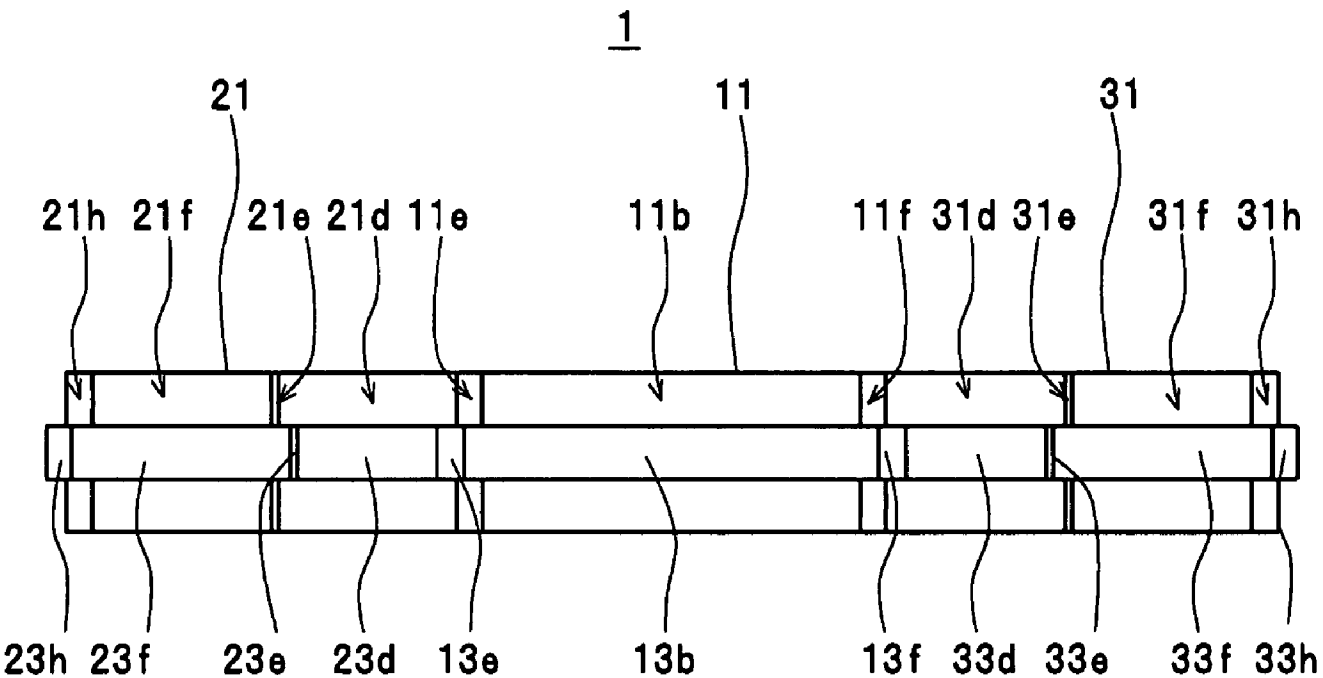
FIG. 5 is a plan view of the building block 1.

The lower face 11*a*, left lower side face 11*c* and right lower side face 11*d* of the base body part 11 are formed with respective fitting grooves 12*a*, 12*c* and 12*d* (hereinafter also simply referred to as "the fitting groove(s) 12" when it is not necessary to distinguish between them) extending along the respective faces in the left-right direction in a continuous manner. In this case, as shown in FIG. 3, the fitting grooves 12*a*, 12*c* and 12*d* are formed in the respective central portions, in the direction of thickness, of the lower face 11*a*, the left lower side face 11*c* and the right lower side face 11*d*. Further, as shown in FIG. 4, each of the fitting grooves 12 is formed into a rectangular cross-sectional shape having a width L2 which is approximately one third as long as a thickness L1 of the building block 1, and a depth L3 which is approximately two thirds as long as the width L2. On the other hand, as shown in FIG. 2, the upper face 11*b*, left upper side face 11*e* and right upper side face 11*f* of the base body part 11 has respective fitting protrusions 13*b*, 13*e* and 13*f* (hereinafter also simply referred to as "the fitting protrusion(s) 13"when it is not necessary to distinguish between them) extending along the respective faces in the left-right direction in a continuous manner. In this case, as shown in FIG. 5, the fitting protrusions 13*b*, 13*e* and 13*f* are formed in the respective central portions, in the direction of thickness, of the upper face 11*b*, the left upper side face 11*e* and the right upper side face 11*f*. Further, as shown in FIG. 4, each of the fitting protrusions 13 is formed into a rectangular cross-sectional shape having a width L4 which is approximately one third as long as the thickness L1 of the building block 1, and a height L5 which is approximately two thirds as long as the width L4. Thus, each of the fitting protrusions 13 has the same or substantially the same cross-sectional shape as that of the fitting groove 12.

The protruding part 21 corresponds-to a first protruding part according to the present invention, and is formed in a manner protruding leftward from the base body part 11 as shown in FIG. 1. In this case, as shown in FIG. 2, the protruding part 21 has a lower surface thereof formed by left sloping faces 21*a* to 21*c* corresponding, respectively, to first to third left sloping faces according to the present invention. Further, the protruding part 21 has an upper surface thereof formed by left sloping faces 21*d* to 21*f* corresponding, respectively, to fourth to sixth left sloping faces according to the present invention, and a left side surface thereof formed by left sloping faces 21*g* and 21*h* corresponding, respectively, to seventh and eighth left sloping faces according to the present invention. As shown in the figure, the left sloping face 21*a* is formed continuous with the left end (protruding portion according to the present invention) of the left lower side face 11*c* of the base body part 11 such that as the left sloping face 21*a* extends leftward, it becomes closer to a central horizontal axis Hc located at the center in the vertical direction of the building block 1 and in the direction of thickness of the same. On the other hand, the left sloping face 21*b* is formed continuous with the left end of the left sloping face 21*a* such that as the left sloping face 21*b* extends leftward, it becomes more distant from the central horizontal axis Hc. In this case, the left sloping face 21*b* is formed in a manner inclined at approximately 90 degrees (preferably 90 degrees) to the left sloping face 21*a*. On the other hand, the left sloping face 21*c* is formed continuous with the left end of the left sloping face 21*b* such that as the left sloping face 21*c* extends leftward, it becomes closer to the central horizontal axis Hc. In this case, the left sloping face 21*c* is formed in a manner inclined at approximately 90 degrees (preferably 90 degrees) to the left sloping face 21*b*. In short, the left sloping faces 21*a* and 21*c* are formed in substantially parallel relationship (preferably parallel) to each other.

As shown in FIG. 2, the left sloping face 21*d* is formed continuous with the left end (protruding portion according to the present invention) of the left upper side face 11*e* of the base body part 11 such that as the left sloping face 21*d* extends leftward, it becomes closer to the central horizontal axis Hc. The left sloping face 21*e* is formed continuous with the left end of the left sloping face 21*d* such that as the left sloping face 21*e* extends leftward, it becomes more distant from the central horizontal axis Hc. In this case, the left sloping face 21*e* is formed in a manner inclined at approximately 90 degrees (preferably 90 degrees) to the left sloping face 21*d*. On the other hand, the left sloping face 21*f* is formed continuous with the left end of the left sloping face 21*e* such that as the left sloping face 21*f* extends leftward, it becomes closer to the central horizontal axis Hc. In this case, the left sloping face 21*f* is formed in a manner inclined at approximately 90 degrees (preferably 90 degrees) to the left sloping face 21*e*. In short, the left sloping faces 21*d* and 21*f* are formed in substantially parallel relationship (preferably parallel) to each other. The left sloping face 21*g* is formed continuous with the left end of the left sloping face 21*c* such that the left sloping face 21*g* extends parallel with the right lower side face 11*f* of the base body part 11. The left sloping face 21*h* is formed continuous with the left end of the left sloping face 21*f* such that the left sloping face 21*h* extends parallel with the right lower side face 11*d* of the base body part 11. In this case, the left sloping faces 21*g* and 21*h* have left ends thereof connected to each other to form the left side surface of the protruding part 21.

Further, as shown in FIG. 2, the left sloping faces 21*a* to 21*c* and 21*g* of the protruding part 21 are formed with respective fitting grooves 22*a* to 22*c* and 22*g* (hereinafter also simply referred to as "the fitting groove(s) 22" when it is not necessary to distinguish between them) extending along the respective faces in the left-right direction in a continuous manner. In this case, the fitting groove 22*a* is formed in a manner continuous with the fitting groove 12*c* of the base body part 11. As shown in FIG. 3, the fitting grooves 22*a* to 22*c* and 22*g* are formed such that they extend along the central portions, in the direction of thickness, of the respective left sloping faces 21*a* to 21*c* and 21*g*. Further, each of the fitting grooves 22 has the same or substantially the same cross-sectional shape as that of the fitting groove 12 of the base body part 11. On the other hand, as shown in FIG. 2, the left sloping faces 21*d* to 21*f* and 21*h* of the protruding part 21 have respective fitting protrusions 23*d* to 23*f* and 23*h* (hereinafter also simply referred to as "the fitting protrusion(s) 23" when it is not necessary to distinguish between them) extending along the respective faces in the left-right direction in a continuous manner. In this case, the fitting protrusion 23*d* is formed in a manner continuous with the fitting protrusion 13*e* of the base body part 11. As shown in FIG. 5, the fitting protrusions 23*d* to 23*f* and 23*h* are formed such that they extend along the respective central portions, in the direction of thickness, of the left sloping faces 21*d* to 21*f* and 21*h*. Further, each of the fitting protrusions 23 has the same or substantially the same cross-sectional shape as that of the fitting protrusion 13 of the base body part 11.

The protruding part 31 corresponds to a second protruding part according to the present invention, and is formed in a manner protruding rightward from the base body part 11 as shown in FIG. 1. In this case, as shown in FIG. 2, the protruding part 31 has a lower surface thereof formed by left sloping faces 31*a* to 31*c* corresponding, respectively, to first to third right sloping faces according to the present invention. Further, the protruding part 31 has an upper surface thereof formed by right sloping faces 31*d* to 31*f* corresponding, respectively, to fourth to sixth right sloping faces according to the present invention, and a right side surface thereof formed by right sloping faces 31*g* and 31*h* corresponding, respectively, to seventh and eighth right sloping faces according to the present invention. As shown in the figure, the right sloping face 31*a* is formed continuous with the right end (protruding portion according to the present invention) of the right lower side face 11*d* of the base body part 11 such that the right sloping face 31*a* extends parallel with the left sloping face 21*f* of the protruding part 21. On the other hand, the right sloping face 31*b* is formed continuous with the right end of the right sloping face 31*a* such that the right sloping face 31*b* extends parallel with the left sloping face 21*e*. Further, the right sloping face 31*c* is formed continuous with the right end of the right sloping face 31*b* such that the right sloping face 31*c* extends parallel with the left sloping face 21*d*.

The right sloping face 31*d* is formed continuous with the right end (protruding portion according to the present invention) of the right upper side face 11*f* of the base body part 11 such that the right sloping face 31*d* extends parallel with the left sloping face 21*c* of the protruding part 21. The right sloping face 31*e* is formed continuous with the right end of the right sloping face 31*d* such that the right sloping face 31*e* extends parallel with the left sloping face 21*b*. Further, the right sloping face 31*f* is formed continuous with the right end of the right sloping face 31*e* such that the right sloping face 31*f* extends parallel with the left sloping face 21*a*. In short, the right sloping faces 31*d* and 31*f* are formed parallel or substantially parallel with each other. The right sloping face 31*g* is formed continuous with the right end of the right sloping face 31*c* such that the right sloping face 31*g* extends parallel with the left upper side face 11*e* of the base body part 11. Further, the right sloping face 31*h* is formed continuous with the right end of the right sloping face 31*f* such that the right sloping face 31*h* extends parallel with the left lower side face 11*c* of the base body part 11. In this case, the right sloping faces 31*g* and 31*h* have right ends thereof connected to each other to form the right side surface of the protruding part 31.

Further, as shown in FIG. 2, the right sloping faces 31*a* to 31*c* and 31*g* of the protruding part 31 are formed with respective fitting grooves 32*a* to 32*c* and 32*g* (hereinafter also simply referred to as "the fitting groove(s) 32" when it is not necessary to distinguish between them) extending along the respective faces in the left-right direction in a continuous manner. In this case, the fitting groove 32*a* is formed in a manner continuous with the fitting 12*d* of the base body part 11. As shown in FIG. 3, the fitting grooves 32*a* to 32*c* and 32*g* are formed such that they extend along the central portions, in the direction of thickness, of the respective right sloping faces 31*a* to 31*c* and 31*g*. Further, each of the fitting grooves 32 has the same or substantially the same cross-sectional shape as that of the fitting groove 12. On the other hand, as shown in FIG. 2, the right sloping faces 31*d* to 31*f* and 31*h* of the protruding part 31 have respective fitting protrusions 33*d* to 33*f* and 33*h* (hereinafter also simply referred to as "the fitting protrusion(s) 33" when it is not necessary to distinguish between them) extending along the respective faces in the left-right direction in a continuous manner. In this case, the fitting protrusion 33*d* is formed in a manner continuous with the fitting protrusion 13*f* of the base body part 11. As shown in FIG. 5, the fitting protrusions 33*d* to 33*f* and 33*h* are formed such that they extend along the respective central portions, in the direction of thickness, of the right sloping faces 31*d* to 31*f* and 31*h*. Further, each of the fitting protrusions 33 has the same or substantially the same cross-sectional shape as that of the fitting protrusion 13.

In a state where a structure is assembled with these building blocks 1, 1, . . . , the fitting groove 12*a* of one building block 1 is fitted on the fitting protrusion 13*b* of another building block 1 positioned immediately below, and the fitting protrusion 13*b* of the one building block 1 is fitted in the fitting groove 12*a* of still another building block 1 positioned immediately above. Further, the fitting groove 12*c* and the fitting grooves 22 of the one building block 1 are fitted, respectively, on the fitting protrusions 33 and fitting protrusion 13*f* of another building block 1 positioned at the lower left of the one building block 1, and the fitting groove 12*d* and the fitting grooves 32 of the same are fitted, respectively, on the fitting protrusions 23 and fitting protrusion 13*e* of another building block 1 positioned at the lower right. Furthermore, the fitting protrusions 23 and fitting protrusion 13*e* of the one building block 1 are fitted, respectively, in the fitting groove 12*d* and the fitting grooves 32 of another building block 1 positioned at the upper left, and the fitting protrusions 33 and fitting protrusion 13*f* of the same are fitted, respectively, in the fitting groove 12*c* and the fitting grooves 22 of another building block 1 positioned at the upper right. Each of the faces formed with the respective fitting grooves or fitting protrusions is held in intimate contact with the associated one of the fitting grooves or fitting protrusions of an adjacent one of the other building blocks 1, 1, . . . , whereby high airtightness of the assembled structure (particularly at the fitted portions of the fitting grooves and the fitting protrusions) can be ensured.

Next, a method of assembling a structure, e.g. a wall-like one, using building blocks 1 will be described with reference to the drawings.

Figure 6:
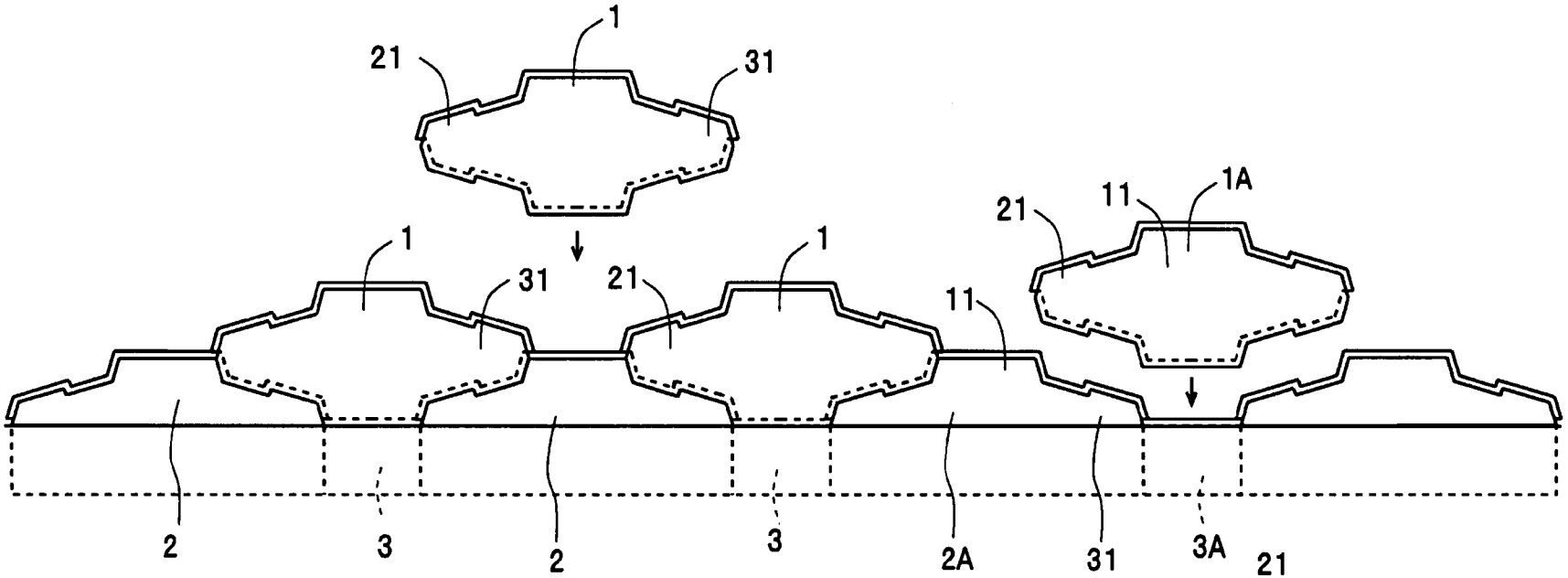
FIG. 6 is a front view of a structure assembled using the building blocks 1.

First, a plurality of base blocks 2, 2, . . . , and base blocks 3, 3, . . . are alternately arranged in a side-by-side fashion as shown in FIG. 6. In this case, the base block 2 is formed such that an upper portion thereof has the same or substantially the same shape as that of the upper half body of the building block 1, and a lower portion thereof as a base part has the shape of e.g. a rectangular parallelepiped. On the other hand, the base block 3 is formed such that a base body part thereof has the shape of a rectangular parallelepiped and a width equal to the length, in the left-right direction, of the fitting protrusion 13*b* of the building block 1, with a fitting protrusion formed on the top surface of the base body part such that the fitting protrusion has the same shape as that of the fitting protrusion 13*b*. In order to arrange the base blocks 2 and the base blocks 3 in a side-by-side fashion, the base blocks 2 and the base blocks 3 are positioned alternately, and then fixed by burying the base body part of each base block underground or connecting the same onto a concrete foundation or the like e.g. by bolts. Therefore, it is not required to form a base at a building site, so that assembly of the structure can be started immediately. Next, as shown in the figure, a building block 1 (for example, a building block 1A shown in the figure) is moved downward from above to be positioned between two adjacent base blocks 2 (for example, between a base block 2A and a base block 2B shown in the figure (i.e. on the upper side of a base block 3A shown in the figure)).

More specifically, the fitting grooves 22*g*, 22*c*, 22*b*, 22*a*, and 12*c* of the building block 1A are fitted on the fitting protrusions 13*f*, 33*d* to 33*f*, and 33*h* of the base block 2A, respectively, and the fitting groove 12*a* of the building block 1A is fitted on the fitting protrusion of the base block 3A. At the same time, the fitting grooves 12*d*, 32*a* to 32*c*, and 32*g* of the building block 1A are fitted on the fitting protrusions 23*h*, 23*f*, 23*e*, 23*d*, and 13*e* of the base block 2B, respectively. In doing, as the building block 1A is moved downward, the left sloping faces 21*g*, 21*c*, 21*b* and 21*a* and left lower side face 11*c* of the building block 1A approach the right upper side face 11*f* and right sloping faces 31*d*, 31*e*, 31*f* and 31*h* of the base block 2A, respectively, and the lower face 11*a* of the building block 1A approaches the top surface of the base body part of the base block 3A. At the same time, the right lower side face 11*d* and right sloping faces 31*a*, 31*b*, 31*c* and 31*g* of the building block 1A approach the left sloping faces 21*h*, 21*f*, 21*e* and 21*d* and left upper side face 11*e* of the base block 2B, respectively, and finally the associated faces come into contact with each other. In this case, since the faces are each formed as a sloping face, the downward movement of the building block 1A does not cause friction, so that the building block 1A can be positioned simply by its own weight or with a slight force.

In the state where the building block 1A is positioned, the building block 1A is supported by the faces of the base blocks 2A, 2B and 3A in contact with the associated faces of the building block 1A, so that the downward movement of the building block 1A is stopped. Further, when the building block 1A attempts to move leftward, the right sloping face 31*h* and right upper side face 11*f* of the base block 2A and the left sloping face 21*e* of the base block 2B come into abutment with the left lower face 11*c*, left sloping face 21*g* and right sloping face 31*b* of the building block 1A, respectively, so that the leftward movement of the building block 1A is stopped. On the other hand, when the building block 1A attempts to move rightward, the right lower face 11*d*, right sloping face 31*g* and left sloping face 21*b* of the building block 1A come into abutment with the left sloping face 21*h* and left upper side face 11*e* of the base block 2B and the right sloping face 31*e* of the base block 2A, respectively, so that the rightward movement of the building block 1A is stopped. Further, when the building block 1A attempts to move in the direction of its thickness, faces forming the fitting grooves of the building block 1A come into abutment with faces forming the fitting protrusions of the base blocks 2A, 2B and 3A, so that the movement of the building block 1A in the direction of its thickness is stopped. Thus, the building block 1A is fitted to the base blocks 2A, 2B and 3A without moving downward, leftward and rightward, and in the direction of its thickness. In addition, since the fitting grooves have the same or substantially the same cross-sectional shape as that of the fitting protrusions, the faces forming the fitting grooves and the faces forming the fitting protrusions are held in intimate contact with each other. Therefore, high airtightness is ensured at the fitted portions of the building block 1A and the base blocks 2A, 2B and 3A, which makes it possible to prevent infiltration of rain water from the front (back) surface of the building block 1A to the back (front) surface of the same.

Subsequently, another building block 1 is positioned between the base block 2B and another base block 2, not shown, adjacent to the base block 2B. Similarly, thereafter, other building blocks 1, 1, . . . are each positioned between the associated two of the other base blocks 2, 2, . . . to thereby form a first row of building blocks arranged in a side-by-side fashion. In this case, since the building block 1 is formed such that the right-hand half body thereof and the left-hand half body thereof are rotationally symmetrical with respect to the central vertical axis Vc, the building block 1 can be used without distinguishing between the front and the back, which makes it possible to arrange the building blocks 1 efficiently. Next, as shown in FIG. 6, building blocks 1, 1, . . . are positioned from above the first row of building blocks 1, 1, . . . to form a second row of building blocks arranged in a side-by-side fashion. Thereafter, similarly, a third row, a fourth row, . . . of building blocks are arranged in a side-by-side fashion to a predetermined height. As a result, the structure is assembled with the building blocks 1. In this case, each of the building blocks 1 can be positioned simply by its own weight or with a slight force as described hereinabove, so that it is possible to assemble a highly airtight structure with ease. It should be noted that building blocks used to form the side edge portions of the structure are each in the form of the right-hand half body of the building block 1 or the left-hand half body of the same, and building blocks used to form the top portion of the structure are each in the form of the lower half body of the building block 1.

As described above, according to the present building block 1, the base body part 11 has the left and right lower side faces 11*c* and 11*d* and the left and right upper side faces 11*e* and 11*f* each formed as a sloping face; the protruding part 21 has the lower surface thereof formed by the left sloping faces 21*a* to 21*c*, the upper surface thereof formed by the left sloping faces 21*d* to 21*f*, and the side surface thereof formed by the left sloping faces 21*g* and 21*h*; the protruding part 31 has the lower surface thereof formed by the right sloping faces 31*a* to 31*c*, the upper surface thereof formed by the right sloping faces 31*d* to 31*f*, and the side surface thereof formed by the right sloping faces 31*g* and 31*h*; the left sloping faces 21*a* to 21*c* and 21*g*, the left lower side face 11*c*, the lower face 11*a*, the right lower side face 11*d*, and the right sloping faces 31*a* to 31*c* and 31*g* are formed with the fitting grooves 22, 12 and 32, respectively, and the left sloping faces 21*d* to 21*f* and 21*h*, the left upper side face 11*e*, the upper face 11*b*, the right upper side face 11*f*, and the right sloping faces 31*d* to 31*f* and 31*h* are formed with the fitting protrusions 23, 13 and 33, respectively. As a result, the building block 1 can be fitted to other building blocks 1 simply by its own weight or by pushing in the building block 1 with a slight force without causing friction between the associated faces, so that it is possible to easily assemble a structure which ensures high airtightness at the fitted portions of the fitting grooves 22, 12 and 32 and the fitting protrusions 23, 13 and 33. Moreover, since the building block 1 is formed such that the right-hand half body thereof and the left-hand half body thereof are rotationally symmetrical with respect to the central vertical axis, the building block 1 can be used without distinguishing between the front and the back in assembling the structure, which makes it possible to dispense with work for distinguishing between the front and the back, thereby enhancing working efficiency.

Figure 7:
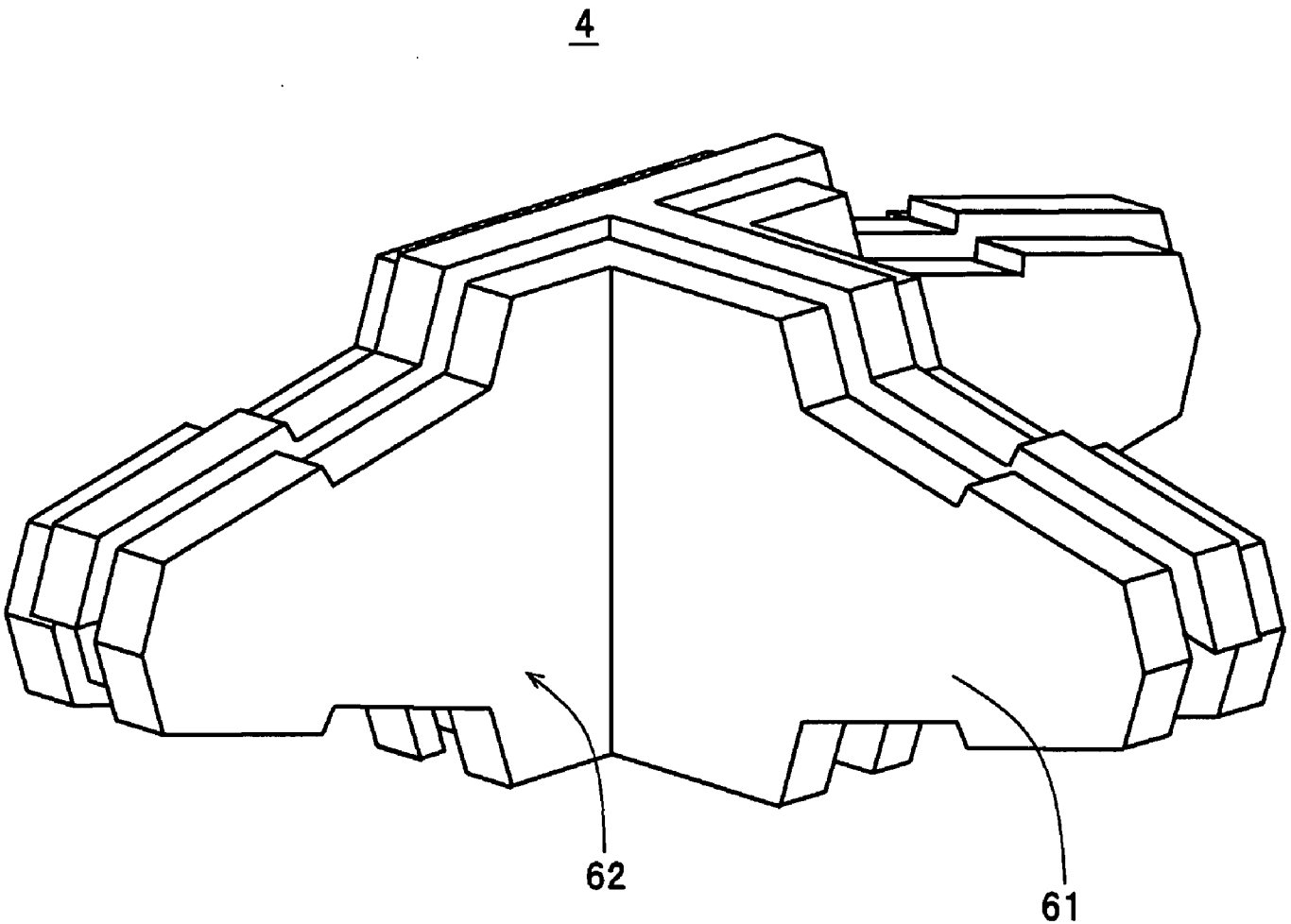
FIG. 7 is a perspective view of a building block 4.

It should be noted that the present invention is by no means limited to the above described construction. For example, it is possible to form a building block 4 (another embodiment of the block according to the present invention) integrally formed with a branch part 61 having the same or substantially the same shape as that of the right-hand half body (or the left-hand half body) of the building block 1 and protruding perpendicularly from the central portion of one surface 62 as either the front surface or the back surface of a main body part thereof having the same shape as that of the building block 1, as shown in FIG. 7. By using this building block 4, one structure can have another structure connected thereto from a direction perpendicular to the one structure. In this case, in connecting the other structure to the one structure using the building block 4, first, the building block 4 is used in place of a building block 1 at a location where the other structure is connected. Then, a building block 1 is connected to the protruding end of the branch part 61 of the building block 4. According to this building block 4, since the branch part 61 is formed on the one surface 62, one structure can have another structure easily connected thereto. In this case, by providing another branch part protruding from the opposite surface from the one surface in addition to the branch part 61, it is possible to form a building block having the shape of a cross in plan view such that other structures can be connected, respectively, to both the front and back of the one structure.

Figure 8:
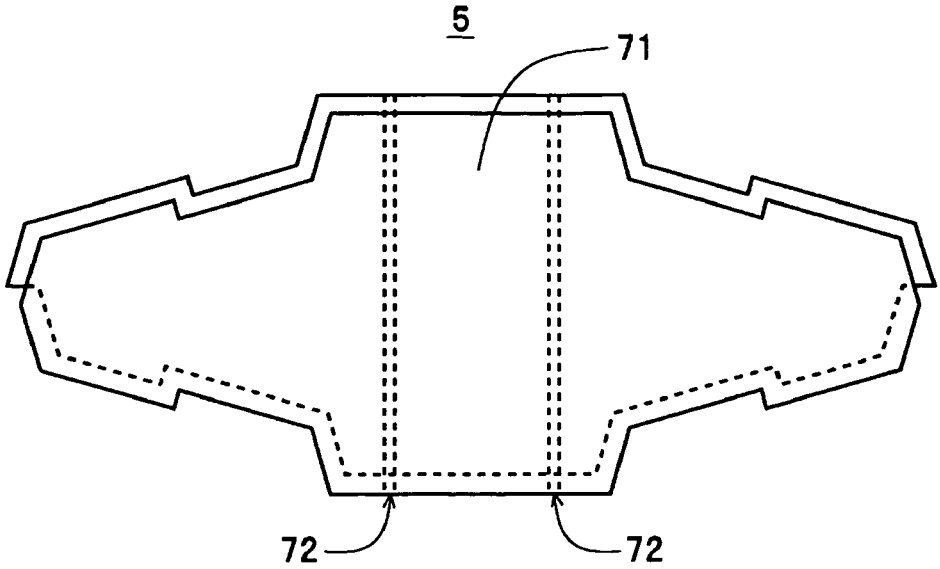
FIG. 8 is a front view of a building block 5.
Figure 9:
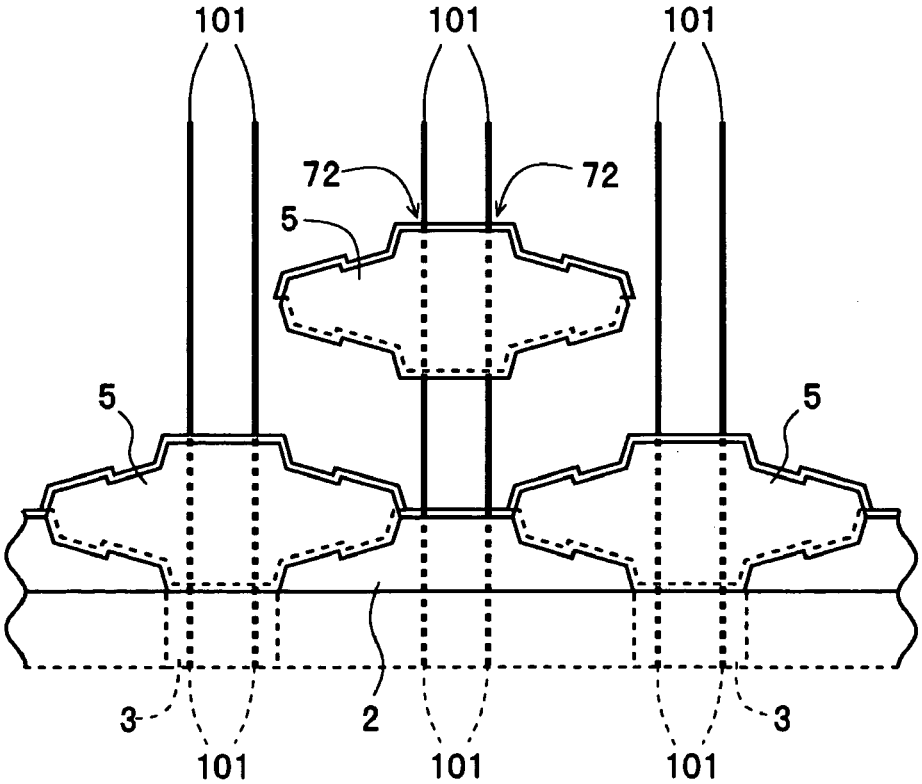
FIG. 9 is a front view of a structure assembled using the building blocks 5.

Further, it is possible to adopt a building block 5 (still another embodiment of the block according to the present invention) having a base body part 71 thereof formed vertically therethrough with insertion holes 72 and 72, as shown in FIG. 8, through each of which can be inserted e.g. a reinforcing bar (corresponding to a reinforcing member according to the present invention; see FIG. 9) 101 for reinforcing a structure. In assembling a wall-like structure using the building blocks 5, reinforcing bars 101, 101, . . . are erected on base blocks 2 and 3 as shown in FIG. 9, and each of the reinforcing bars 101 is inserted through the associated insertion hole 72, whereby the building blocks 5 are arranged in a side-by-side fashion. This method facilitates assembly of a highly airtight and rigid structure. It should be noted that a pair of pipes through each of which a reinforcing bar 101 can be vertically inserted can be provided parallel to each other on the wall surface of the building block 1 instead of forming the insertion holes 72 and 72.

Although in the above described embodiments, the fitting grooves 12, 22 and 32 and the fitting protrusions 13, 23 and 33 are formed to have a rectangular cross-sectional shape, it is also possible to form the fitting grooves 12, 22 and 32 such that each has a desired cross-sectional shape, such as a trapezoid, a triangle, a semi-circle and a semi-ellipse, and to form the fitting protrusions 13, 23 and 33 such that each has a shape complementary to the desired shape. Further, although in the above described embodiments, the right-hand half body and the left-hand half body are formed in rotationally symmetrical relationship with respect to the central vertical axis Vc, the two half bodies can be formed asymmetrically, and this construction of a building block makes it possible to easily assemble a highly airtight structure, similarly to the construction of the building block 1.

Furthermore, each building block 1 can be disposed upside down for assembly of a structure, and this assembly method can also facilitate assembly of a highly airtight structure. In this case, base blocks formed with a fitting groove are used in place of the base blocks 2 formed with the fitting protrusion.

Structures which can be assembled using building blocks 1 include retaining walls for holding back earth, outer walls of large buildings, exteriors (including fences, gate doors, and gateposts), and other various kinds of structures. Further, although in the embodiments described above, the building block 1 is formed using reinforcing bars and concrete, the present invention is by no means limited to the example, but a block can be formed of any one of various materials, such as metals (e.g. steel, aluminum, copper, and stainless, for example), glass (including glass wool), paper, stone, plastic (including foamed plastic), ceramic, wood (including chip materials), cloth, soil, and plants (including straw and bamboo). Furthermore, a plurality of kinds of the above-mentioned materials can be used to form a block, or a mixture of a plurality of kinds of the above-mentioned materials can also be used to form a block. In this case, blocks formed of these materials can be used to assemble outer walls, inner walls, roofs and floors of houses, outdoor or indoor stages (including temporary stages), and so forth. Moreover, it is possible to form structures, such as models (including building models) and toys (block toys), using blocks formed of the materials.

INDUSTRIAL APPLICABILITY

As described above, according to a block of the present invention, the left and right lower side faces and left and right upper side faces of its base body part are each formed as a sloping face. Further, the lower surface, upper surface and left side surface of a first protruding part protruding leftward from the base body part and the lower surface, upper surface and right side surface of a second protruding part protruding rightward from the base body part are each formed by a plurality of sloping faces. Furthermore, the faces of the lower portion of the block are each formed with a fitting groove, while the faces of the upper portion of the block are each formed with a fitting protrusion. As a result, the block can be fitted to other blocks without causing friction between the associated faces and simply by its own weight or by pushing in the block with a slight force. This realizes a block that enables a structure to be easily assembled which ensures high airtightness at the fitted portions of blocks.

The invention claimed is:

1. A block for enabling a structure to be assembled by arranging blocks in a side-by-side fashion with parts thereof fitted to each other, wherein a base body part positioned in a central portion of the block and having upper and lower faces formed such that the upper and lower faces are flat and parallel to each other, a first protruding part protruding leftward from the base body part, and a second protruding part protruding rightward from the base body part are integrally formed with the base body part, wherein the base body part has sloping faces formed from a lower end of a left lower side face of the base body part to a protrusion of the first protruding part, and from a lower end of a right lower side face of the base body part to a protrusion of the second protruding part, such that as the sloping faces extend upward, the sloping faces become more distant from a central vertical axis of the block in a left-right direction, and sloping faces formed from an upper end of a left upper side face of the base body part to a protrusion of the first protruding part and from an upper end of a right upper side face of the base body part to a protrusion of the second protruding part, such that as the sloping faces extend downward, the sloping faces become more distant from the central vertical axis, wherein the first protruding part has a lower surface thereof formed by a first left-hand sloping face formed such that as the first left-hand sloping face extends leftward from the protrusion corresponding to the left lower side face of the base body part, the first left-hand sloping face becomes closer to a central horizontal axis in a vertical direction of the block, a second left-hand sloping face formed continuous with a left end of the first left-hand sloping face such that as the second left-hand sloping face extends leftward, the second left-hand sloping face becomes more distant from the central horizontal axis, and a third left-hand sloping face formed continuous with a left end of the second left-hand sloping face such that as the third left-hand sloping face extends leftward, the third left-hand sloping face becomes closer to the central horizontal axis, an upper surface thereof formed by a fourth left-hand sloping face formed such that as the fourth left-hand sloping face extends leftward from the protrusion corresponding to the left upper side face of the base body part, the fourth left-hand sloping face becomes closer to the central horizontal axis, a fifth left-hand sloping face formed continuous with a left end of the fourth left-hand sloping face such that as the fifth left-hand sloping face extends leftward, the fifth left-hand sloping face becomes more distant from the central horizontal axis, and a sixth left-hand sloping face formed continuous with a left end of the fifth left-hand sloping face such that as the sixth left-hand sloping face extends leftward, the sixth left-hand sloping face becomes closer to the central horizontal axis, and a left side surface thereof formed by a seventh left-hand sloping face formed continuous with a left end of the third left-hand sloping face such that the seventh left-hand sloping face extends parallel with the right upper side face of the base body part, and an eighth left-hand sloping face formed continuous with a left end of the sixth left-hand sloping face such that the eighth left-hand sloping face extends parallel with the right lower side face of the base body part, wherein the second protruding part has a lower surface thereof formed by a first right-hand sloping face formed continuous with the protrusion corresponding to the right lower side face of the base body part such that the first right-hand sloping face extends parallel with the sixth left-hand sloping face, a second right-hand sloping face formed continuous with a right end of the first right-hand sloping face such that the second right-hand sloping face extends parallel with the fifth left-hand sloping face, and a third right-hand sloping face formed continuous with a right end of the second right-hand sloping face such that the third right-hand sloping face extends parallel with the fourth left-hand sloping face, an upper surface thereof formed by a fourth right-hand sloping face formed continuous with the protrusion corresponding to the right upper side face of the base body part such that the fourth right-hand sloping face extends parallel with the third left-hand sloping face, a fifth right-hand sloping face formed continuous with a right end of the fourth right-hand sloping face such that the fifth right-hand sloping face extends parallel with the second left-hand sloping face, and a sixth right-hand sloping face formed continuous with a right end of the fifth right-hand sloping face such that the sixth right-hand sloping face extends parallel with the first left-hand sloping face, and a right side surface thereof formed by a seventh right-hand sloping face formed continuous with a right end of the third right-hand sloping face such that the seventh right-hand sloping face extends parallel with the left upper side face of the base body part, and an eighth right-hand sloping face formed continuous with a right end of the sixth right-hand sloping face such that the eighth right-hand sloping face extends parallel with the left lower side face of the base body part, wherein the seventh left-hand sloping face, the lower surface of the first protruding part, the left lower side face of the base body part, the lower face of the base body part, the right lower side face of the base body part, the lower surface of the second protruding part, and the seventh right-hand sloping face are each formed with a fitting groove extending in a left-right direction thereof, wherein the eighth left-hand sloping face, the upper surface of the first protruding part, the left upper side face of the base body part, the upper face of the base body part, the right upper side face of the base body part, the upper surface of the second protruding part, and the eighth right-hand sloping face are each formed with a fitting protrusion extending in a left-right direction thereof and protruding therefrom, wherein the fitting protrusion formed on the upper face of the base body part of the block is configured such that the fitting protrusion can be fitted in the fitting groove formed in the lower face of the base body part of another block configured similarly to the block, wherein the fitting protrusions formed on the eighth left-hand sloping face, the upper surface of the first protruding part, and the left upper side face of the base body part, respectively, are configured such that the fitting protrusions can be fitted in the respective fitting grooves formed in the right lower side face of the base body part, the lower surface of the second protruding part, and the seventh right-hand sloping face of another block configured similarly to the block, and wherein the fitting protrusions formed on the right upper side face of the base body part, the upper surface of the second protruding part, and the eighth right-hand sloping face, respectively, are configured such that the fitting protrusions can be fitted in the respective fitting grooves formed in the seventh left-hand sloping face, the lower surface of the first protruding part, and the left lower side face of the base body part of another block configured similarly to the block.

2. A block as claimed in claim 1, wherein a right-hand half body and a left-hand half body are formed in rotationally symmetrical relationship with respect to the central vertical axis.

3. A block as claimed in claim 1, wherein a branch part having a same shape as a shape of a right-hand or left-hand half body of the block is formed in a manner protruding from at least one of front and back surfaces of the block.

4. A block as claimed in claim 2, wherein a branch part having a same shape as a shape of a right-hand or left-hand half body of the block is formed in a manner protruding from at least one of front and back surfaces of the block.

5. A block as claimed in claim 1, wherein an insertion hole through which a bar-like reinforcing member can be inserted is formed vertically through the block.

6. A block as claimed in claim 2, wherein an insertion hole through which a bar-like reinforcing member can be inserted is formed vertically through the block.

7. A block as claimed in claim 3, wherein an insertion hole through which a bar-like reinforcing member can be inserted is formed vertically through the block.

8. A block as claimed in claim 4, wherein an insertion hole through which a bar-like reinforcing member can be inserted is formed vertically through the block.

* * * * *